United States Patent [19]

Thoma

[11] 4,414,039

[45] Nov. 8, 1983

[54] METHOD OF ACTIVATING TITANIUM SURFACES

[75] Inventor: Martin Thoma, Munich, Fed. Rep. of Germany

[73] Assignee: Motoren-und Turbinen-Union Munchen GmbH, Munich, Fed. Rep. of Germany

[21] Appl. No.: 322,585

[22] Filed: Nov. 18, 1981

[30] Foreign Application Priority Data

Aug. 21, 1981 [DE] Fed. Rep. of Germany ..... 3133189

[51] Int. Cl.[3] ..... C23F 7/24

[52] U.S. Cl. ..... 148/6.2; 148/6.14 R

[58] Field of Search ..... 148/6.2, 6.14 R

[56] References Cited

U.S. PATENT DOCUMENTS

| | | | |
|---|---|---|---|
| 2,276,353 | 3/1942 | Thompson | 148/6.2 |
| 2,829,091 | 4/1958 | Missel | 148/6.2 |
| 2,946,728 | 7/1960 | Foisel | 148/6.2 |

FOREIGN PATENT DOCUMENTS

| | | | |
|---|---|---|---|
| 960119 | 12/1974 | Canada | 148/6.2 |

*Primary Examiner*—Sam Silverberg

*Attorney, Agent, or Firm*—Posnack, Roberts, Cohen & Spiecens

[57] ABSTRACT

A method of activating titanium surfaces for subsequent cladding with metallic coatings by the steps of wet-blasting, etching and activating, the activating being effected with a solution of chromic acid, hydrofluoric acid and hexafluosilicic acid.

11 Claims, No Drawings

METHOD OF ACTIVATING TITANIUM SURFACES

FIELD OF THE INVENTION

The present invention relates to a method of activating titanium surfaces for the subsequent cladding with metallic coatings in the course of which the surface is first of all wet-blasted with finely granular $Al_2O_3$ and then treated with a fluoride-containing solution for a period of a few minutes at room temperature.

PRIOR ART

One such method is known from British Pat. No. 13 07 649. In this prior-art method, activation is effected in an acetic-acid/hydrofluoric-acid solution after the wet-blasting and etching. However sufficient bond strengths upon the subsequent cladding cannot be obtained with such an activation bath since a heat treatment must be carried out subsequently.

German Patent Application P No. 30 08 314.8-45 which is the priority application of (U.S. patent application Ser. No. 238,627) has proposed a method of this type in which the wet blasting and etching are followed by an activating of the surface with a solution of chromic acid, hydrofluoric acid and arsenic or antimony compounds at temperatures of 35° to 100° C. for a period of 15 to 50 minutes. This proposed method gives excellent bonding properties upon the subsequent cladding with metallic coatings. However, when arsenic and antimony solutions are used, the danger of side reactions is not entirely excluded, which then change the bath so that the desired activating function is not definitely assured. The monitoring and control of the bath is thereby made difficult.

SUMMARY OF THE INVENTION

An object of the present invention is so to provide an improved method of this type in which the activating bath can be controlled precisely and can be supplemented without difficulty, particularly after standing for a long time.

In accordance with the invention, this object is achieved in that the wet-blasting and etching are followed by activating the surface with a solution of chromic acid, fluoric acid, and hexafluosilicic acid at temperatures of 35° to 100° C. for a period of 15 to 50 minutes.

It has been found that the reproducibility of the activation can be improved by the method of the invention. There are improvements also upon use in series manufacture. The activating of the titanium surface is effected in the manner that the surface is increased in its roughness. As another advantage of the method of the invention, the possibility exists, after activation has been effected (roughening of the surface), to store the titanium part untreated even for a long period of time since the newly-forming oxide skin is not detrimental for further treatment due to the bonding process by the enlarged surface.

DESCRIPTION PREFERRED EMBODIMENTS

A particularly long-lasting activation can be obtained if the hexafluosilicic acid, hydrofluoric acid and chromic acid are present in the solution for the activation of the surface in the following molar ratios (referred to the constituent elements):

$$7 \geqq F/Si \geqq 6$$

$$6 \geqq Cr/Si \geqq 3$$

Within these limits an excellent activation was obtained in an illustrative embodiment with the following molar concentrations:

$H_2SiF_6$: 0.6 mol/L

HF: 0.3 mol/L $CrO_3$: 1.8 mol/L

The hexafluosilicic acid concentration should advantageously be selected between 0.1 and 2.0 mol/L.

In the method of the invention, silicon is present as an oxide, acid, fluoride compound, or fluorine-complex compound for the hexafluosilic acid of the activating solution.

It has been found that when this method is used, metal layers can be deposited with particularly high bond strength on titanium surfaces, obtaining bond strengths of about 70 $N/mm^2$. As in the method of German application P No. 30 08 314.8-45 which is the priority application of (U.S. application Ser. No. 238,627), all method steps can be carried out at temperatures below 60° C. so that the covering with wax necessary for selective cladding is possible. In this way selective cladding can be very considerably simplified. Finally another advantage of the method of the invention is that absorption of hydrogen by the base material is excluded.

In the method of the invention, the fluoride-containing solution which serves as an etching agent comprises a solution of nitric acid and hydrofluoric acid present in respective concentrations of 400 g/l and 5 g/l.

What is claimed is:

1. A method of activating a titanium surface for subsequent cladding with a metallic coating comprising wet blasting a titanium surface with finely granular $Al_2O_3$, contacting the thus wet-blasted surface with a fluoride-containing solution for a period of a few minutes at room temperature, and activating said surface with a solution consisting essentially of chromic acid, hydrofluoric acid and hexafluosilicic acid in following molar ratios of the constituent elements:

$$7 \geqq F/Si \geqq 6$$

$$6 \geqq Cr/Bi \geqq 3$$

at a temperature of 35° to 100° C. for 15 to 50 minutes.

2. A method as claimed in claim 1 wherein the solution for the activating of the surface contains a concentration of hexafluosilicic acid between 0.1 and 2.0 mol/L.

3. A method as claimed in claim 1 wherein silicon is used as an oxide compound, acid compound, fluoride compound or fluorine-complex compound for the hexafluosilicic acid of the activating solution.

4. A method as claimed in claim 3 wherein the fluoride-containing solution is an etching agent which comprises a solution of nitric-acid and hydrofluoric-acid.

5. A method as claimed in claim 1 wherein the acids are present in said etching agent in the respective concentrations of 400 g/L of $HNO_3$ and 5 g/L of HF.

6. A method as claimed in claim 1 wherein the activating solution consists of the acids in the following amounts:

hexafluousilic acid: 0.6 mol/L hydrofluoric acid: 0.3 mol/L
chromic acid: 1.8 mol/L.

7. In a method of activating a titanium surface for subsequent plating with a metallic coating comprising wet blasting a titanium surface to be plated with fine grain $Al_2O_3$, and contacting the thus wet-blasted surface with a fluoride-containing solution for a period of several minutes at room temperature, the improvement comprising activating the wet-blasted titanium surface, following contact with the fluoride containing solution, with an activating solution consisting essentially of chromic acid, hydrofluoric acid and hexafluosilic acid in the following molar ratios of the constituent elements:

$$7 \geqq F/Si \geqq 6$$

$$6 \geqq Cr/Bi \geqq 3$$

at a temperature of 35° to 100° C. for 15 to 50 minutes.

8. The improvement as claimed in claim 7 wherein the solution for the activating of the surface contains a concentration of hexafluosilicic acid between 0.1 and 2.0 mol/L.

9. The improvement as claimed in claim 7 wherein silicon is used as an oxide compound, acid compound, fluoride compound or fluorine-complex compound for the hexafluosilicic acid of the activating solution.

10. The improvement as claimed in claim 7 wherein the activating solution consists of the acids in the following amounts:

hexafluousilic acid: 0.6 mol/L
hydrofluoric acid: 0.3 mol/L
chromic acid: 1.8 mol/L.

11. A solution for activating a titanium surface for subsequent metallic plating thereof, said solution; consisting essentially of: chromic acid, hydrofluoric acid and hexafluosilic acid, said acids being present in the following amounts:

hexafluosilicic acid: 0.6 mol/L
hydrofluoric acid: 0.3 mol/L
chromic acid: 1.8 mol/L.

* * * * *